US006451129B2

(12) United States Patent
Sato et al.

(10) Patent No.: US 6,451,129 B2
(45) Date of Patent: Sep. 17, 2002

(54) TITANIUM-BASE DECORATION MEMBER AND METHOD FOR CURING THE SAME

(75) Inventors: Masahiro Sato; Yoshitugu Sibuya; Junji Sato, all of Saitama (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/230,131

(22) PCT Filed: Jul. 18, 1997

(86) PCT No.: PCT/JP97/02513

§ 371 (c)(1),
(2), (4) Date: Jan. 19, 1999

(87) PCT Pub. No.: WO98/03693

PCT Pub. Date: Jan. 29, 1998

(30) Foreign Application Priority Data

Jul. 18, 1996 (JP) ..... 8-189110
Mar. 19, 1997 (JP) ..... 9-66263

(51) Int. Cl.[7] ..... C23C 8/28

(52) U.S. Cl. ..... 148/237; 148/238; 148/281; 148/284; 148/669; 427/255.36

(58) Field of Search ..... 148/237, 238, 148/281, 284, 669, 317; 428/687, 472; 427/255.36

(56) References Cited

U.S. PATENT DOCUMENTS 4,768,757 A * 9/1988 Nikamura et al. ..... 266/252
5,316,594 A * 5/1994 Kemp ..... 148/281

FOREIGN PATENT DOCUMENTS

| | | |
|---|---|---|
| EP | 0 905 271 | 10/1997 |
| FR | 2465788 | 3/1981 |
| JP | 58-37383 B | 8/1983 |
| JP | 59-10429 B | 3/1984 |
| JP | 61-69956 A | 4/1986 |
| JP | 05279835 | 2/1987 |
| JP | 62-21865 B | 5/1987 |
| JP | 63210286 | 12/1992 |
| JP | 6-41715 A | 2/1994 |
| WO | WO 93/06257 | 4/1993 |

* cited by examiner

*Primary Examiner*—John Sheehan
*Assistant Examiner*—Andrew L. Oltmans
(74) *Attorney, Agent, or Firm*—Scully, Scott, Murphy & Presser

(57) ABSTRACT

A decorative titanium material according to the present invention eliminates a deterioration of the appearance even after processing, that is, provides a small surface roughness, and has a hardened layer of titanium at the surface of the titanium material, this hardened surface layer including nitrogen and oxygen, and having a surface crystal grain size in the range from 0.1 to 60 $\mu$m.

10 Claims, 8 Drawing Sheets

TITANIUM-BASE DECORATION MEMBER AND METHOD FOR CURING THE SAME

FIELD OF THE INVENTION

The present invention relates to decorative titanium material that is hardened on its surface and therewithin, and to a method of hardening such a titanium material.

BACKGROUND OF THE INVENTION

In recent years, titanium and titanium alloys have come to be used in variety of fields, making use of the light weight and rustless of these materials, and the fact that they do not produce allergic reactions.

These features are particularly effective when these materials are used as materials for wrist watches, and been the subject of applications in this field in the past.

Titanium and titanium alloys, however, do have the drawback of being intrinsically susceptible to surface damage. Because such applications as mirror-surface finishing to achieve an attractive appearance would mean that damage to the surface would be visually apparent, in the past these materials have been subjected to sandblasting or the like so that damage is not readily apparent.

For this reason, the general public has developed an image of titanium and titanium alloys as having a dull surface when used as a decorative material.

The phenomenon of being easily damaged is attributed to a low surface hardness, and a variety of types of hardening have been performed with respect to titanium.

Methods of surface-hardening titanium can be divided into two main types: those which coat the titanium material surface with a hard film, and those which harden the titanium material itself.

Known methods of coating the titanium surface with a hard film include such wet processes as electroplating, and such dry processes as vacuum deposition, ion plating, sputtering, and plasma CVD. All of these methods, however, have problems with regard to achieving an intimate attachment to the material, and have not been developed to the point of solving the problem of film peeling.

Known methods of hardening the titanium material itself include ion implantation, ion nitriding, gas nitriding, gas carburizing, and gas soft nitriding. Because these methods, however, require a long processing time they present a problem with regard to productivity, and because of the high processing temperature used with these methods, the crystal grains become coarsen, causing surface roughness, this presenting problems with regard to a deterioration in a quality of outer appearance, and limiting the scope of usefulness.

As a result, for surfaces of wrist watches, eyeglasses, and accessories, in which an attractive appearance is required, it was not possible in the past to maintain the surface roughness that was achieved before hardening after hardening is performed.

Of the above-noted methods, because the method of hardening the titanium material itself results in a gradient of concentration of a diffused element from the surface within the metal, there is no problem with film peeling, and this method is thought to be effective as a method of surface-hardening titanium material.

However, there is still the problem of a deterioration in the quality of appearance caused by a surface roughness.

In ion nitriding technology, to reduce the degree of surface roughness, a method that has been used is that of reducing the sputtering effect. However, there has not been a basic reduction in the surface roughness caused by diffusion of nitrogen, carbon, or oxygen into the material itself.

Thus, in methods such as gas nitriding, carburizing, and oxidation for hardening the titanium material itself, the prior art did not include, as a method of reducing the surface roughness, such approaches as performing preprocessing to change the surface roughness of the material itself before processing, and did not envision attention to be paid to the size of crystal grains of the metal material itself, or the size of the crystal grains that grow in a planar direction on the hardened surface.

The problem of deterioration in quality of appearance is thought to be particularly attributable to a surface roughness caused by protrusions at the crystal grain boundary occurring at the initial phase.

Protrusions at the crystal grain boundary which occur in gas nitriding and in oxidization and nitriding are thought to be caused by stress concentrations at the crystal grain boundary that are caused by the formation of compounds at the crystal grain boundary or by lattice distortion caused by solid solution of nitrogen and oxygen.

If the protrusions at the crystal grain boundary are observed on a visual observation, a roughening of the surface can be perceived, this in particular making application impossible for use of the titanium material as a decorative material with a mirror polished.

As the height of these protrusions increases, the maximum height Rmax and mean surface roughness Ra increase, and the quality of the appearance deteriorates.

It has been discovered that the height of the protrusions at the crystal grain boundary is attributed to the size of the crystal grains in the titanium material before processing, and that the height of the protrusions becomes larger, the larger are the crystal grains that grow in the planar direction after hardening of the titanium material or the larger are the crystal grains before hardening.

In gas nitriding as done in the past, because heating is done to a temperature that is close to the transformation point (850° C. to 870° C.), a phenomenon of the crystal grains become coarse occurs and, from the above considerations, there is a further enlarging of the protrusions at the crystal grain boundary.

In particular in the case of a decorative metal material using either titanium or a titanium alloy, with gas nitriding as done in the past, because heating is done to a temperature that is close to the transformation point (800° C. to 870° C.), the crystal grains become coarse, and a stress concentration occurs at the crystal grain boundary, caused by the formation of compounds at the crystal grain boundary or by lattice distortion caused by solid solution of nitrogen, oxygen or carbon, this causing protrusions at the crystal grain boundary.

The height of these protrusions is larger, the larger is the higher of the size of the crystal grains of titanium or titanium alloy itself before processing. When viewed on a visual observation, there is a perception of a surface roughness, this leading to the problem of not being able to use this material, in particular, as a decorative material having a mirror polished.

That is, in a method such as gas nitriding, carburizing, oxidation, or nitriding, in which the titanium material itself is hardened as was done in the past, it was not possible to solve the problem of deterioration of the appearance, that is, to solve the problem of surface roughness of the material after the hardening process.

Accordingly, it is an object of the present invention to solve the problems accompanying the above-noted prior art, by providing a hardened titanium material that does not exhibit a deterioration in appearance even after hardening, and exhibits little surface roughness.

DISCLOSURE OF THE INVENTION

In order to achieve the above-noted object, a hardened titanium material and method of hardening a titanium material according to the present invention has the following technical constitution.

Specifically, the present invention is a decorative titanium material 2 which has a hardened layer 20 over a titanium material 21, the hardened layer 20 on the surface includes nitrogen and oxygen, and also the size of the crystal grains 24 at the surface of this decorative titanium material 2 (the diameter indicated as 26 in FIG. 1) is in the range from 0.1 to 60 $\mu$m, and the maximum height of the surface roughness Rmax of the decorative titanium material 2 is no more than 1000 nm.

A method of hardening a decorative titanium material according to the present invention has a step of heating so as to raise the temperature of the titanium material in an inert gas atmosphere, a first hardening step of heating the titanium material in a first atmosphere, which is an atmosphere that includes nitrogen and oxygen, to a processing temperature of at least 700° C. , a second atmosphere adjustment step of heating the titanium material in an inert gas atmosphere of argon or helium or the like to a processing temperature of at least 700° C. , and a step of cooling the titanium material in an inert gas atmosphere.

Another aspect of a method of hardening a titanium material according to the present invention has a step of forming a protective film 10 that has a fine crystal grain size 24 in the range from 0.1 to 60 $\mu$m onto the surface of a decorative titanium material 2, a step of heating the titanium material with a raising temperature in an inert gas atmosphere, a first hardening step of heating the material to a temperature of at least 700° C. in an atmosphere that includes oxygen and nitrogen, as the first atmosphere, a second atmosphere adjustment step of heating the titanium material in an inert gas atmosphere of argon or helium or the like to a processing temperature of at least 700° C. , and a step of cooling the titanium material in an inert gas atmosphere.

Yet another aspect of a method of hardening a decorative titanium material having a hardened surface layer according to the present invention has a step of forming a protective film having a crystal grain size in the range from 0.1 to 60 $\mu$m onto the surface of the decorative titanium material, a step of heating the titanium material with a rising temperature in an inert gas atmosphere, a first hardening step of heating the material to a temperature of at least 700° C. in an atmosphere that includes oxygen and nitrogen, as the first atmosphere, a second atmosphere adjustment step of heating the titanium material in an inert gas atmosphere of argon or helium or the like to a processing temperature of at least 700° C., and a step of cooling the titanium material in an inert gas atmosphere.

In a hardened titanium material obtained by the decorative titanium material hardening method of the present invention, by making the crystal grain size after processing be in the range from 0.1 to 60 $\mu$m, or by a step of forming a protective film thereonto which has microfine crystal grains, it is possible to eliminate the deterioration of the appearance after processing, that is, it is possible to obtain a surface with little roughness.

It is clear that the problem with deterioration of the appearance with regard to the present invention is attributed to a surface roughness caused by protrusions at the crystal grain boundary 22 in the initial phase.

The protrusions in the crystal grain boundary 22 that occur during processing by gas nitriding, oxidation and nitriding or the like are thought to be caused by stress concentrations at the crystal grain boundary that are caused by the formation of compounds at the crystal grain boundary or by lattice distortion caused by solid solution of nitrogen or oxygen.

If the protrusions at the crystal grain boundary 22 are observed visually, a surface roughness is perceived, this presenting a particular problem, in that use of the material is not possible as a decorative material with a mirror polished.

As the height of these protrusions increases, the maximum height of surface roughness Rmax and mean surface roughness Ra increase, and the quality of the outer appearance deteriorates. In the present invention, it was discovered that the height of the protrusions at the crystal grain boundary is attributed to the size of the crystal grains in the titanium material itself before processing, and that the height of the protrusions becomes larger, the larger are the crystal grains of the titanium material.

In the case of using titanium or a titanium alloy as a decorative metal material, protrusions occur at the crystal grain boundary, these occurring due to stress concentration at the crystal grain boundary because of the formation of compounds such as titanium nitride (TiN) and titanium oxide ($TiO_2$) at the crystal grain boundary, or lattice distortion caused by solid solution of nitrogen and oxygen.

The larger is the crystal grain size of the titanium or titanium alloy before processing, the greater will be the height of the above-noted protrusions.

When this is viewed on a visual observation, it is permitted as a roughening of the surface, this leading to a deterioration of the appearance, making the material unusable in particular as a decorative material with a mirror polished.

Additionally, after processing, as the formation of compounds such as titanium nitride (TiN) proceeds at the crystal grain boundary and within the grains, this phenomenon can be observed as a surface roughness of the surface on a macro level, this also representing a deterioration of the outer appearance that makes the material unusual in particular as a decorative material with a mirror polished.

By using a titanium material having a surface with crystal grains having sizes in the range from 0.1 to 60 $\mu$m, and performing heat treating under controlled temperature and time conditions in an atmosphere that includes nitrogen and oxygen, by virtue of the effect of a small crystal grain size before heat treating and the effect of nitrogen and oxygen that are solid solution into the crystal grain boundary inhibiting the coarsening of the crystal grains, it is possible to maintain crystal grains that grow in a planar direction with a size of 0.1 to 60 $\mu$m while performing the processing.

When the above-noted processing is performed, the height of the protrusions at the crystal grain boundary reduced. That is, stress at the crystal grain boundary that occurs because of the lattice distortion caused by the solid solution and diffusion of nitrogen and oxygen is distributed by the effects such as an increase in the proportional of unit surface area occupied by the crystal boundaries.

As a result of this phenomenon, there is a reduction in the surface roughness which, when viewed on a visual observation, makes it possible to inhibit the deterioration in the appearance of the material.

In the present invention, by forming a protective film having a crystal grain size in the range 0.1 to 60 μm onto the surface of a decorative titanium material and then performing heat treating thereof in an atmosphere of nitrogen and oxygen, the effects of a microfine crystal grain size before heat treating and the inhibition by nitrogen and oxygen of a roughening of the crystal grain size are achieved, making it possible to maintain surface crystal grain size that grow in a planar direction with a size of 0.1 to 60 μm while performing the processing.

In this case, for the same reasons described above, the height of the protrusions at the crystal grain boundary is reduced.

That is, as shown in FIG. 5, using a titanium material that has a large crystal grain size of its surface, when hardening is performed the crystal grains become enlarged, resulting in protrusions at the crystal grain boundaries.

However, as shown in FIG. 4, if hardening is performed of a titanium material having a surface with small crystal grain size, the crystal grain size after processing are also small, and it can be seen that the protrusions at the crystal grain boundaries are reduced in size as well.

DESCRIPTION OF THE PREFERRED EMBODIMENTS

The first embodiment of the present invention, as noted above, is a hardened titanium material that has a hardened layer that hardens the surface of the titanium material, the surface hardened layer including nitrogen and oxygen, and having surface crystal grains having a size in the range from 0.1 to 60 μm. The second embodiment of the present invention has, in addition to the above-noted constitution, the feature that the maximum height of surface roughness Rmax is no greater than 1000 nm.

The third embodiment of the present invention is a method of hardening a titanium material so as to produce a decorative titanium material of various embodiments, this method having a step of heating so as to raise the temperature of a titanium material in an inert gas atmosphere, a first hardening step of heating the titanium material in a first atmosphere, which is an atmosphere that includes nitrogen and oxygen, to a processing temperature of at least 700° C., a second atmosphere adjustment step of heating the titanium material in an inert gas atmosphere of argon or helium or the like to a processing temperature of at least 700° C., and a step of cooling the titanium material in an inert gas atmosphere.

Specific examples of a decorative titanium material and method of hardening a decorative titanium material according to the present invention are described below in detail, with reference being made to accompanying drawings.

Figure 1:
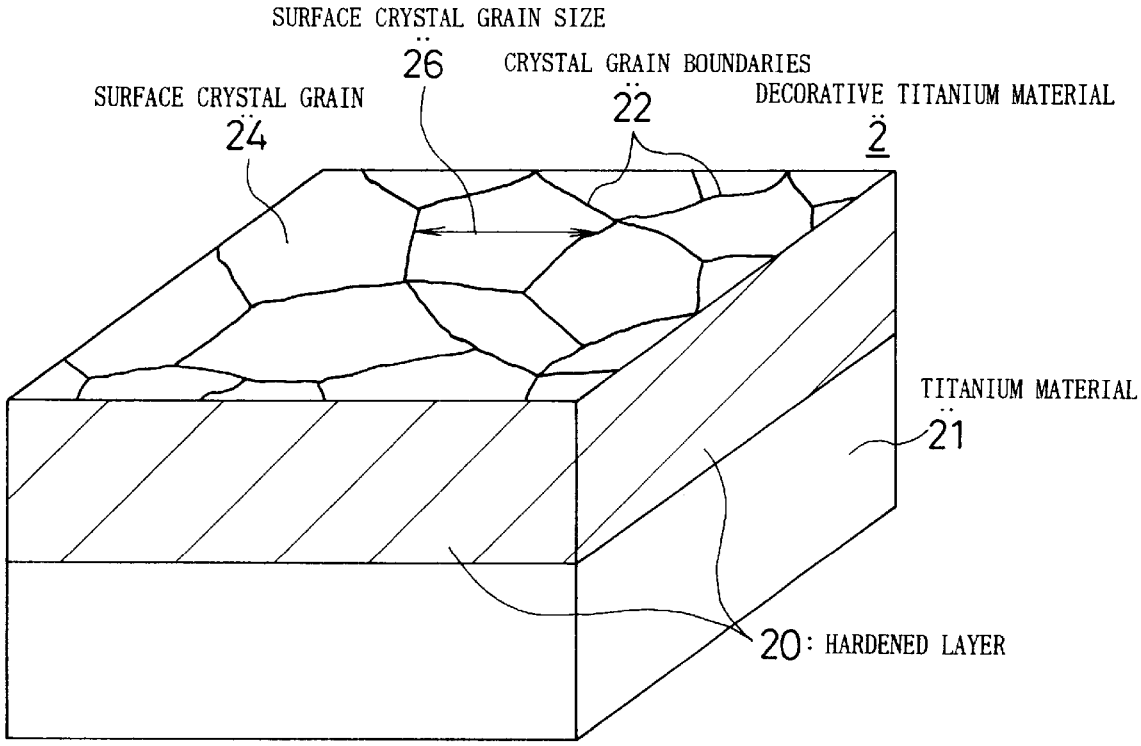
FIG. 1 is a perspective view that shows the hardened titanium material onto which has been formed a hardened layer in accordance with an embodiment of the present invention.
Figure 2:
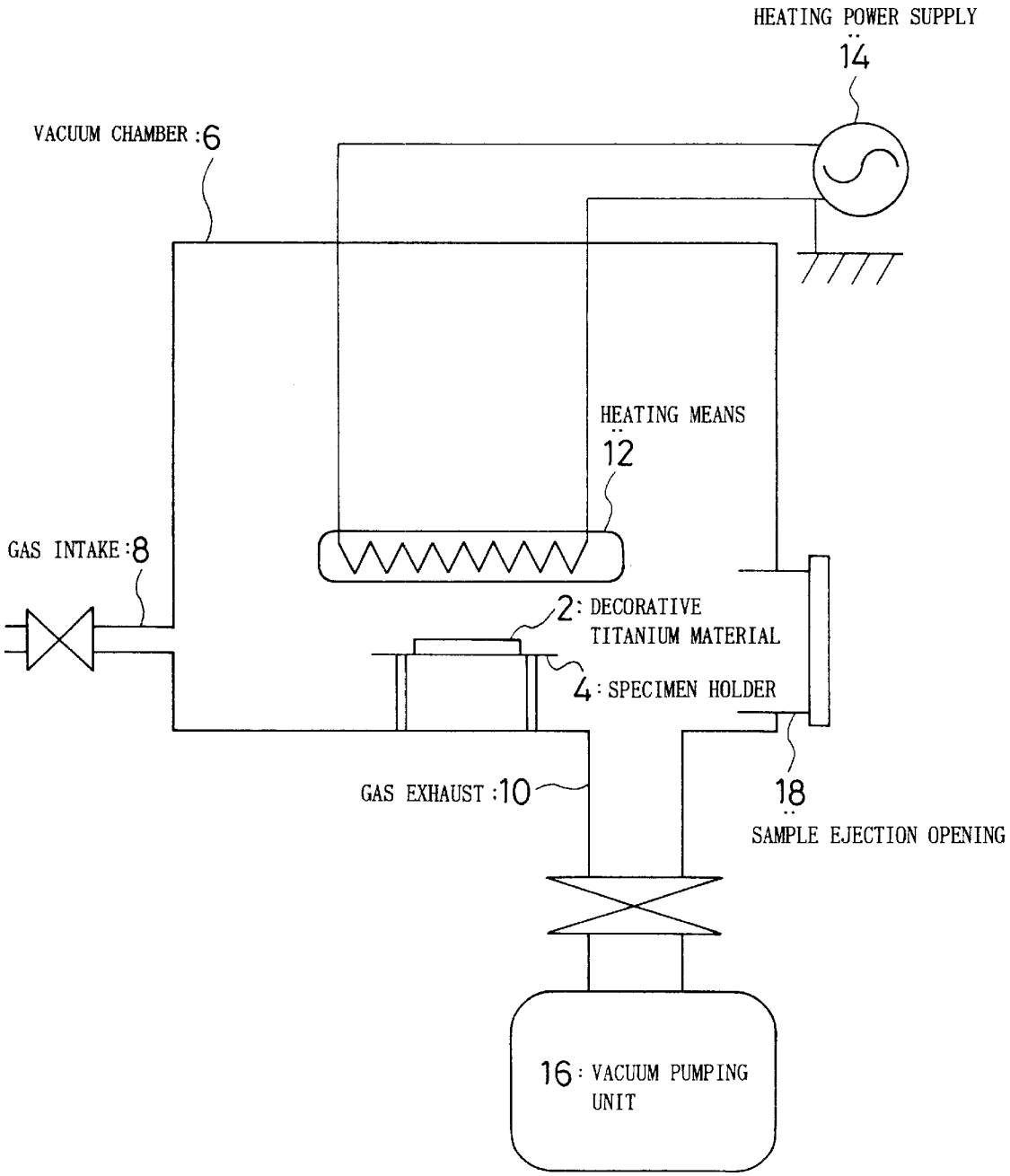
FIG. 2 is a schematic representation of processing apparatus for the purpose of forming a hardened layer for a titanium material according to an embodiment of the present invention.
Figure 3:
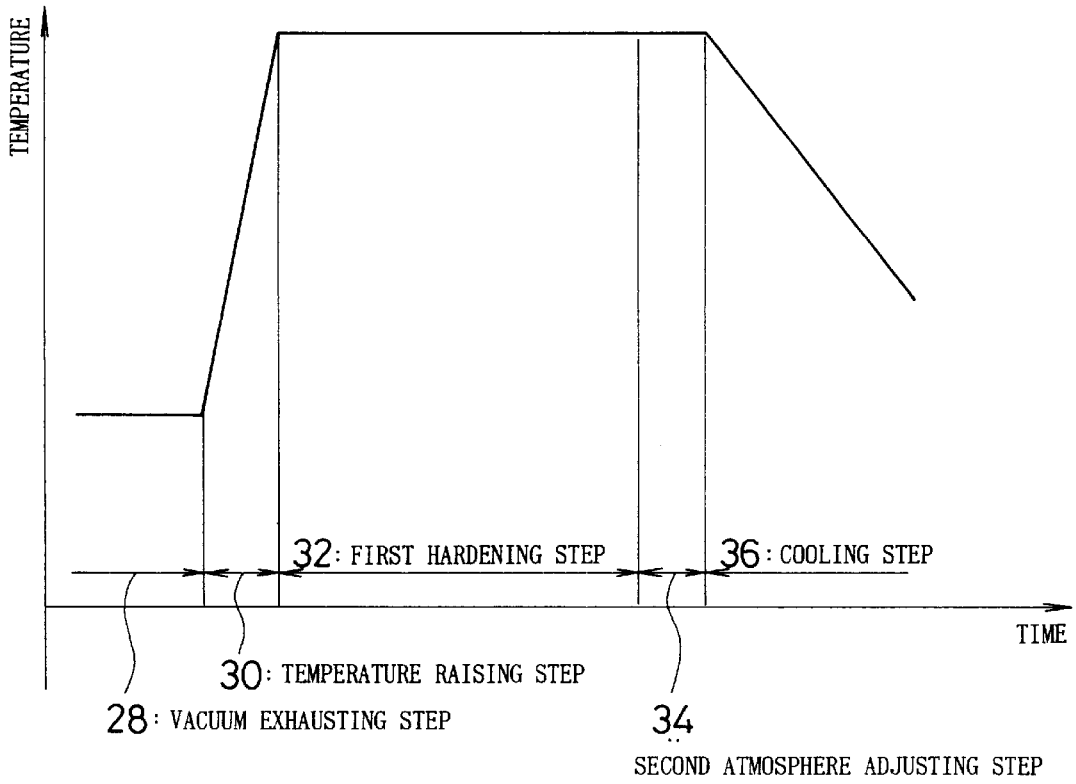
FIG. 3 is a schematic representation of the process steps for the purpose of forming a hardened layer for a titanium material according to an embodiment of the present invention.
Figure 4:
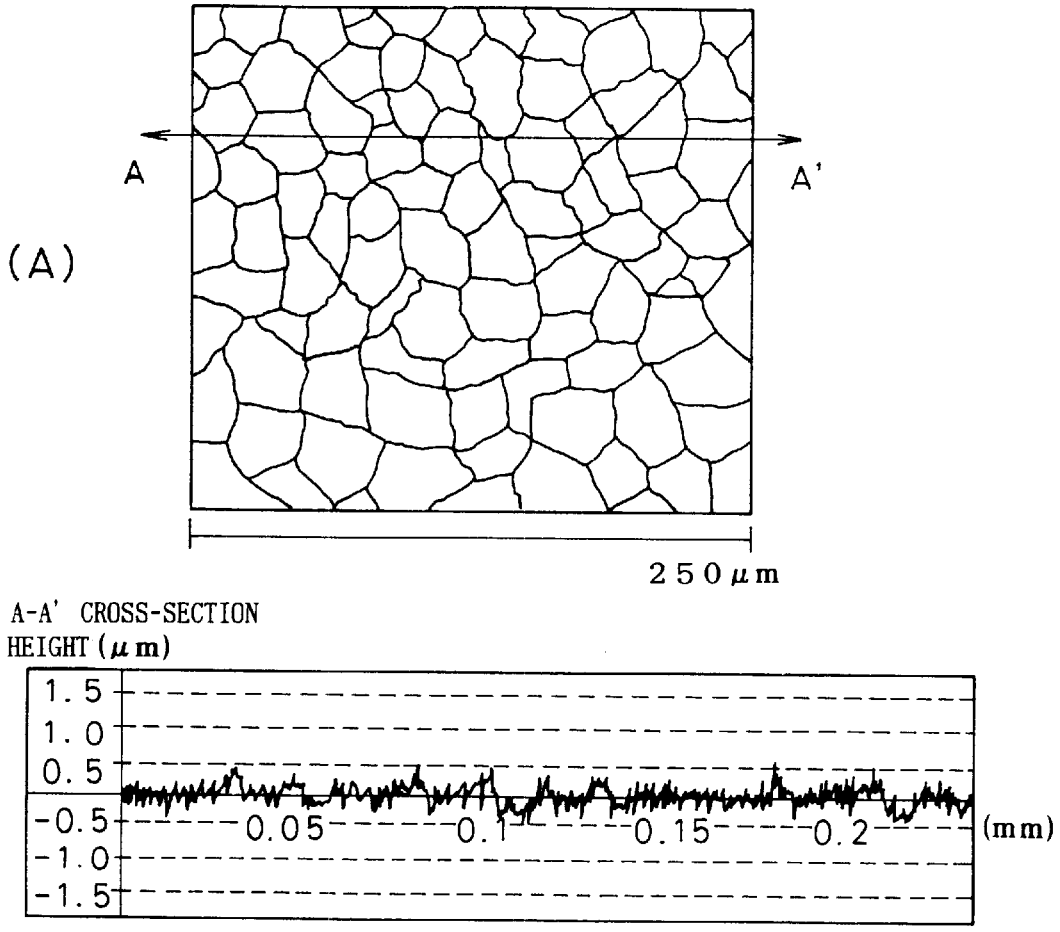
FIG. 4 (A) is an enlarged view of the crystal grains for the case of forming at processing temperature of 700° C. a hardened layer, according to an embodiment of the present invention, for a titanium material having small crystal grains, and FIG. 4 (B) is a graph that shows the results of measuring the surface roughness thereof.
Figure 5:
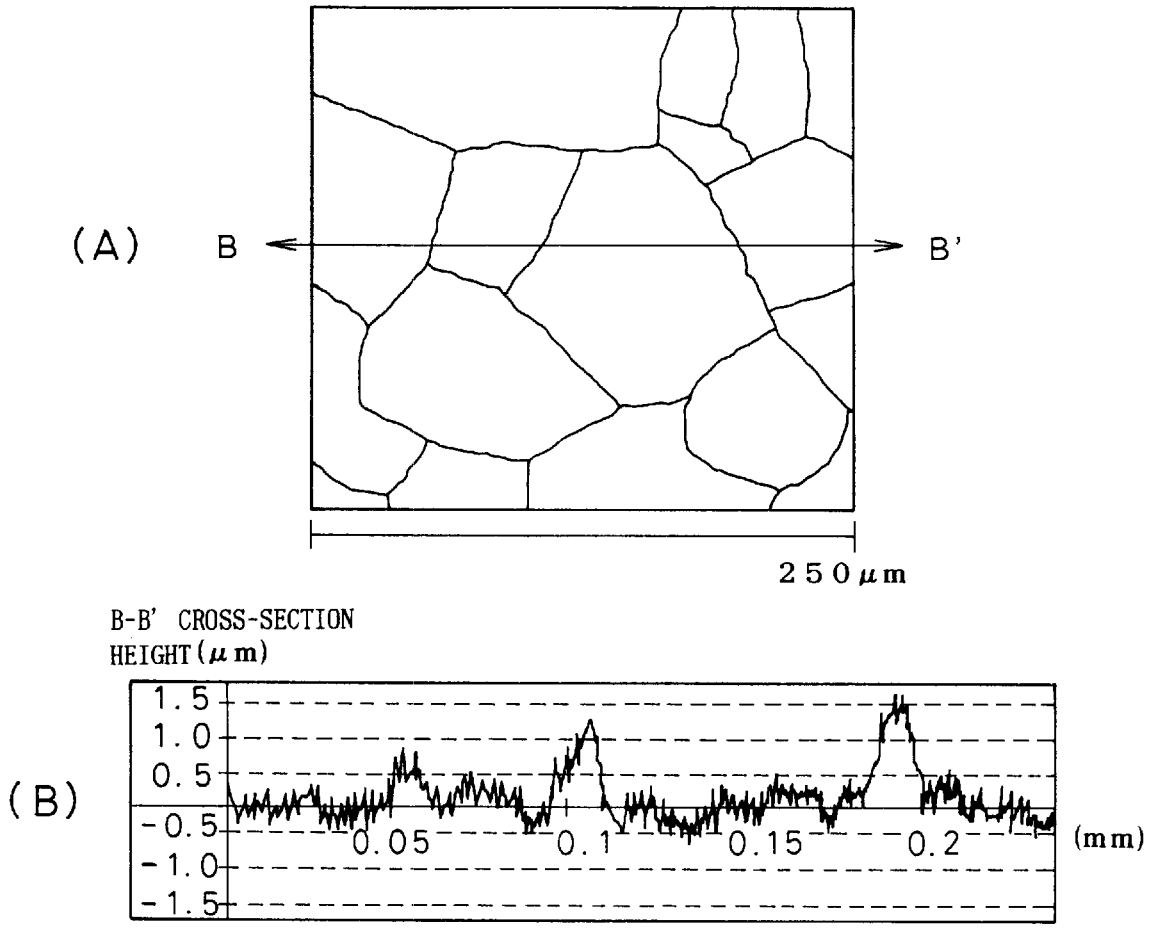
FIG. 5 (A) is an enlarged view of the crystal grains for the case of forming at processing temperature of 700° C. a hardened layer, according to an embodiment of the present invention, for a titanium material having large crystal grains, and FIG. 5 (B) is a graph that shows the results of measuring the surface roughness thereof.

Specifically, FIG. 1 is an enlarged perspective view of a hardened titanium material for which is formed a hardened layer by means a hardening process according to the present invention, and FIG. 2 is a conceptual view of an apparatus for hardening the surface of titanium material according to the present invention. FIG. 3 is a schematic representation of the process steps for the purpose of forming a hardened layer for a titanium material according to the present invention.

As shown in FIG. 2, an apparatus for use in the present invention is one which has, in a vacuum chamber 6 that has a gas conduit 8 and a sample ejection opening 18, a heating means 12 that is supplied with energy by a power heating power source 14, this heating means causing heating of the surface of a decorative titanium material 2 that is disposed on top of a specimen holder 4.

A vacuum pumping units 16 and gas exhaust 10 are provided, enabling vacuum exhausting in the vacuum chamber 6, thereby enabling hardening to be performed in a reduced-pressure atmosphere.

Embodiment 1

The first embodiment of the present invention will now be described in detail, making use of FIG. 1, FIG. 2, and FIG. 3.

In this embodiment, pure titanium of JIS class 2 (corresponding to ASTM grade 2) measuring 25 mm by 25 mm is used as the titanium material. The surface to be processed is polished, and the surface roughness is such that the maximum height of surface roughness Rmax value is 50 nm or less. The crystal structure has non-processed crystal grain of a size within the range from 10 to 30 μm.

FIG. 3 is a conceptual representation of the process steps of hardening method according to the present invention.

First, at the vacuum exhausting step 28, the inside of the vacuum chamber 6 is exhausted by the vacuum pumping units 16, to a vacuum level of $1\times10^{-5}$ torr or below.

A prescribed amount of an inert gas such as argon or helium is introduced from the gas conduit 8, this amount of introduced gas and the exhaust amount being adjusted so as to achieve an inert gas atmosphere within the vacuum processing chamber 6 having a vacuum pressure of 0.1 torr.

Then, as indicated by the temperature raising step 30, the decorative titanium material 2 is heated by the heating means 12, so that its temperature rises to the processing temperature of 700° C.

At the first hardening step 32, a gas mixture that includes pure nitrogen and nitrogen with a minute amount of steam vapor is introduced from the gas conduit conduit 8, this amount of introduced gas and the exhaust amount being adjusted so as to achieve an atmosphere of nitrogen and water vapor having a vacuum pressure of approximately 0.1 torr.

The proportion of water vapor with respect to the above-noted nitrogen is made to be approximately 4000 ppm. Then, while maintaining a constant processing temperature, the above condition is held for approximately 3 hours, after which the atmosphere within the vacuum chamber 6 is again established as a reduced-pressure inert gas atmosphere, this being maintained for approximately 0.5 hour, and the second atmosphere adjustment step is performed.

Cooling is performed with the inert gas atmosphere remaining and, when the decorative titanium material reaches a temperature at which its surface will not be oxidized, processing is completed and the specimen is removed.

Embodiment 2

The second embodiment of the present invention will be described with reference being made to FIG. 1 through FIG. 3.

Specifically, a wrist watch case made of a high-strength titanium material having fine crystal grains and corresponding to ASTM grade 4 is used in this embodiment as the hardened titanium material.

The surface to be processed is polished, and the surface roughness is such that the maximum height of surface roughness Rmax value is 50 nm or less. The crystal structure has a non-processed crystal grain of a size no greater than 5 $\mu$m.

In the hardening method illustrated in FIG. 3, at the vacuum exhausting step 28 the inside of the vacuum chamber 6 is first exhausted to a vacuum level of $1\times10^{-5}$ torr or below.

A prescribed amount of an inert gas such as argon or helium or the like is introduced from the gas conduit 8, this amount of introduced gas and the exhaust amount being adjusted so as to achieve an inert gas atmosphere within the vacuum chamber 6 of 0.1 torr.

Then, at the temperature raising step 30, the decorative titanium material 2 is heated by the heating means 12, so that its temperature rises to the processing temperature of 700° C.

At the first hardening step 32, a gas mixture that includes pure nitrogen and nitrogen with a minute amount of water vapor is introduced from the gas conduit 8, this amount of introduced gas and the exhaust amount being adjusted so as to achieve an atmosphere of nitrogen and nitrogen with a minute amount of oxygen having a vacuum pressure of approximately 0.1 torr.

The proportion of oxygen with respect to the above-noted nitrogen is made to be approximately 5000 ppm. Then, while maintaining a constant processing temperature, the above condition is held for approximately 3 hours, after which the atmosphere within the vacuum chamber 6 is again established as a reduced-pressure inert gas atmosphere, this being maintained for approximately 0.5 hour, and the second atmosphere adjustment step is performed.

Cooling is then performed with the inert gas atmosphere remaining and, when the decorative titanium material reaches a temperature at which its surface will not be oxidized, processing is completed and the specimen is takenout.

Embodiment 3

The third embodiment of the present invention will be described with reference being made to FIG. 1 through FIG. 3.

Specifically, in this embodiment, a titanium alloy measuring 25 mm by 25 mm, and having a composition of 4.5 wt % Al, 3 wt % V, and 2 wt % Mo, with the remaining content being titanium, is used as the titanium material. The surface to be processed in polished, and the surface roughness is such that the maximum height of surface roughness of Rmax value is 50 nm or less.

The crystal structure has a non-process crystal grain of a size no greater than 5 $\mu$m.

In the hardening method illustrated in FIG. 3, at the vacuum exhausting step 28 the inside of the vacuum chamber 6 is first exhausted to a vacuum level of $1\times10^{-5}$ torr or below.

A prescribed amount of an inert gas such as argon or helium or the like is introduced from the gas conduit 8, this amount of introduced gas and the exhaust amount being adjusted so as to achieve an inert gas atmosphere within the vacuum chamber 6 of 0.1 torr.

Then, at the temperature raising step 30, the decorative titanium material 2 is heated by the heating means 12, so that its temperature rises to the processing temperature of 700° C.

At the first hardening step 32, a gas mixture that includes pure nitrogen and nitrogen with a minute amount of water vapor is introduced from the gas conduit 8, this amount of introduced gas and the exhaust amount being adjusted so as to achieve an atmosphere of nitrogen and nitrogen with a minute amount of water vapor having a vacuum pressure of approximately 0.1 torr.

The proportion of water vapor with respect to the above-noted nitrogen is made to be approximately 4000 ppm.

Then, while maintaining a constant processing temperature, the above condition is held for approximately 3 hours, after which the atmosphere within the vacuum processing chamber 6 is again established as a reduced-pressure inert gas atmosphere, this being maintained for approximately 0.5 hour, and the second atmosphere adjustment step is performed.

Cooling is then performed with the inert gas atmosphere remaining and, when the decorative titanium material reaches a temperature at which its surface will not be oxidized, processing is completed and the sample is removed.

The method of hardening a decorative titanium material according to the present invention is described in more detail below.

Specifically, in a hardening method according to the present invention as shown in FIG. 3, when the titanium material is heated to a temperature of 700° C., the temperature raising step 30 which places the titanium in an inert atmosphere is performed for the purpose of recrystallizing the working strain layer that occurs when the titanium material is polished polishing it.

That is, in the working strain layer the stress at the time of the polishing step causes lattice strain, which when it remains causes a condition that is close to the amorphous state.

Therefore, if a gas that includes either nitrogen or oxygen is introduced and hardening performed with the titanium material remaining in the state it is in after polishing, because the working strain layer's reaction with oxygen and nitrogen is large, a nitride or an oxide is formed, this appearing as discolored matter on the surface.

When the above-noted discolored matter is formed, the appearance is marred, making the material unsuitable for use as a decorative material. Thus, it is necessary in the present invention to perform the temperature raising step before the first hardening step in an inert atmosphere.

A feature of the first hardening step 32 in the above-noted hardening method that is performed after the temperature raising step 30, is the introduction into the vacuum chamber a gas mixture that includes a minute amount of oxygen or water vapor added to nitrogen, and the adjustment of the processing pressure to achieve a gas mixture having a pressure within the range from 0.001 to 10 torr.

Additionally, the second atmosphere adjustment step 34 in the above-noted hardening method indicates a step for the purpose of completing exhausting from within the vacuum chamber the nitrogen and oxygen or water vapor gases that were introduced to within the vacuum chamber.

That is, when the subsequent cooling step 36 is performed, if there is a nitrogen or an oxygen remaining from the first hardening step, because the temperature of the atmosphere is low, diffusion to within the titanium material is poor, this resulting in the undesirable formation of a nitride or oxide on the surface of the titanium material.

These compounds, as described above, cause a problem in terms of surface roughness and marring of a-quality control appearance, and are undesirable for use as a decorative titanium material.

The cooling step 36 of the hardening method according to the present invention is a process for the purpose of quickly cooling the titanium material to room temperature and taking out the titanium material from within the vacuum chamber.

In this cooling step as well, if the atmosphere is made the same as in the hardening step, because nitrogen and oxygen are supplied during cooling, the condition in which diffusion of nitrogen and oxygen from the surface of the titanium material is poor, the result being the formation of a discolored nitride or oxide on the surface thereof.

To prevent the formation of this discolored matter, it is necessary to perform the cooling step as well in an inert atmosphere.

That a titanium material according to the present invention has the many above-noted superior features in comparison with a processed metal material of the past is thought to be attributable to the fact that the titanium material making up the decorative titanium material is maintained at an appropriate solid solution.

Figure 6:
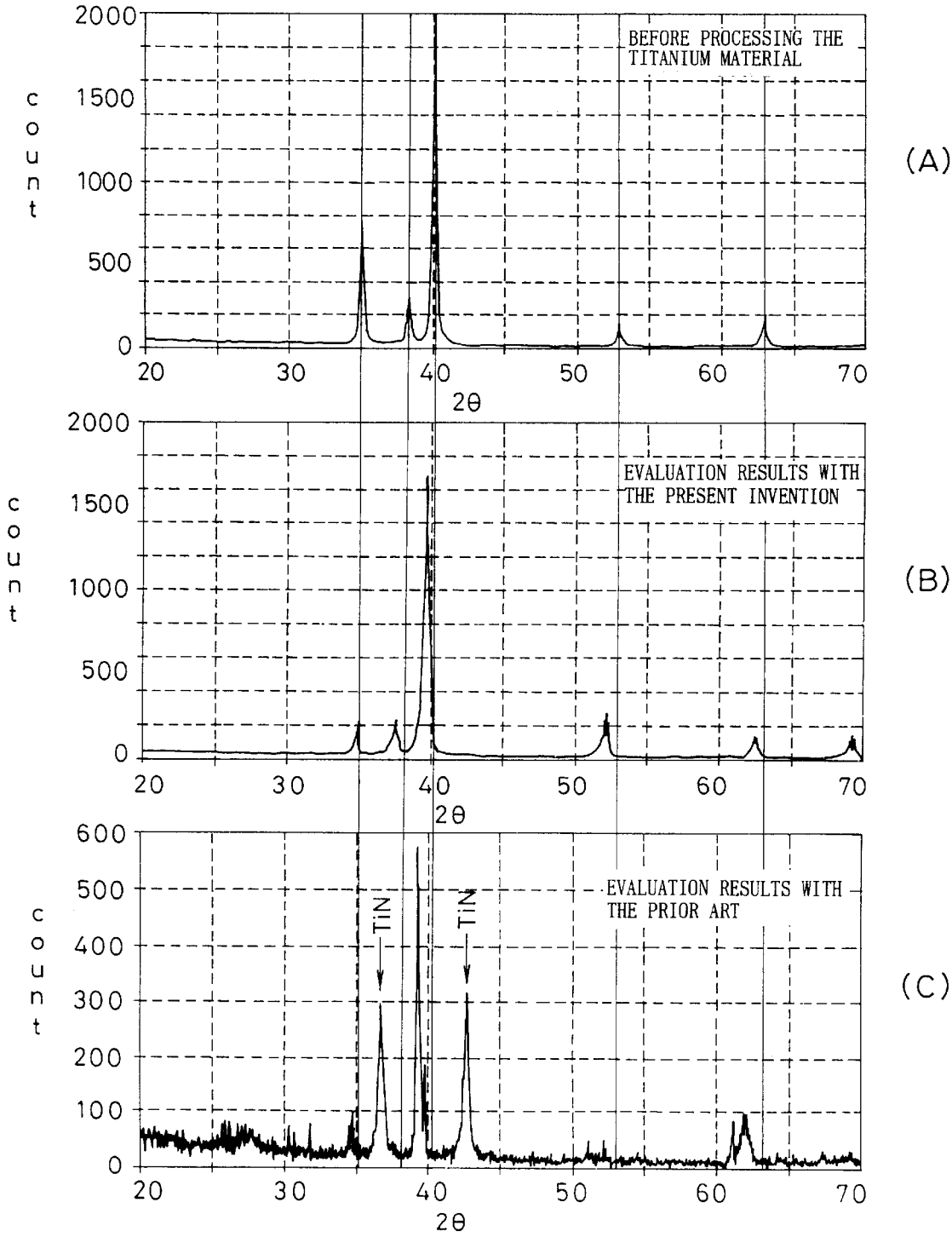
FIG. 6 (A) through FIG. 6 (C) are graphs that show thin-film X-ray diffraction results obtained from a decorative titanium material according to the present invention and a titanium material produced by the prior art.

Specifically, FIGS. 6 (A), (B), and (C) respectively show the results of performing X-ray diffraction with an angle of incidence of 0.5° with respect to a titanium material before performing the hardening method of the present invention, a titanium material with respect to which the hardening method of the present invention has been performed, and a hardened titanium material of the past.

As can be seen from these results, as shown in FIG. 6 (C), the hardened titanium material produced by the prior art exhibits peaks that are clearly different from the titanium material before hardening that is shown at FIG. 6 (A).

This is because of the titanium nitride, which is colored. All of the peaks obtained from the hardened titanium according to the present invention are almost coincident with the positions for the titanium material, the hardened titanium material according to the present invention exhibiting a slight shift in peak values in the direction of lower angles, in comparison with the hardened titanium material before hardening.

This is thought to be because of solid solution of oxygen into the titanium material, which causes a distortion in the lattice. Because other peaks are not observed, it is suspected that compounds have not been formed in this case.

Embodiment 4

Next, the fourth embodiment of the present invention will be described, with reference being made to FIG. 1 through FIG. 3.

In this embodiment, a titanium alloy measuring 25 mm by 25 mm, and having a composition of 3 wt % Al and 2.5 wt % V, with the remaining content being titanium, is used as the titanium material. The surface to be processed is polished, and the surface roughness is such that the maximum height of surface roughness Rmax value is 50 nm or less.

The crystal structure has a non-process crystal grain of a size no greater than 5 $\mu$m.

In the hardening method illustrated in FIG. 3, at the vacuum exhausting step 28 the inside of the vacuum chamber 6 is first exhausted to a vacuum level of $1\times10^{-5}$ torr or below.

A prescribed amount of an inert gas such as argon or helium or the like is introduced from the gas conduit 8, this amount of introduced gas and the exhaust amount being adjusted so as to achieve an inert gas atmosphere within the vacuum chamber 6 of 0.1 torr.

Then, at the temperature raising step 30, the decorative titanium material 2 is heated by the heating means 12, so that its temperature rises to the processing temperature of 700° C.

At the first hardening step 32, a gas mixture that includes pure nitrogen and nitrogen with a minute amount of water vapor is introduced from the gas conduit 8, this amount of introduced gas and the exhaust amount being adjusted so as to achieve an atmosphere of nitrogen and water vapor having a vacuum pressure of approximately 0.1 torr.

The proportion of water vapor with respect to the above-noted nitrogen is made to be approximately 4000 ppm.

Then, while maintaining a constant processing temperature, the above condition is held for approximately 3 hours, after which the atmosphere within the vacuum processing chamber 6 is again established as a reduced-pressure inert gas atmosphere, this being maintained for approximately 0.5 hour, and the second atmosphere adjustment step is performed.

Cooling is then performed with the inert gas atmosphere remaining and, when the decorative titanium material reaches a temperature at which its surface will not be oxidized, processing is completed and the specimen is taken out.

Table 1 is a table that shows a comparison between the results of evaluating this embodiment of the present invention and the results of evaluating the embodiment or the prior art.

The evaluation method used was that of using a damage resistance test (sand dropping test), hardness test, the crystal grain size, and the surface roughness, a go-nogo test with respect to the titanium bulk material itself, without a protective film formed thereon, being performed according to the following criteria.

For the damage resistance test, after performing a sand dropping test an optical microscope was used to observe the surface damage with a magnification of ×400, the surface being passed if the frequency of occurrence of surface damage is 50% or lower.

With regard to hardness, a Vickers hardness tester was used, with a Vickers hardness Hv of 600 or greater to a depth of 5 μm from the hardened surface being taken as passing.

With regard to crystal grain size, an electron microscope and an optical microscope were used to observe the surface, the evaluation of "small" being applied to the case of a crystal grain size in the range from 1 to 60 μm, and the evaluation of "large" being applied to the case of a crystal grain size of 60 μm or greater.

With regard to surface roughness, a surface profile analysis was performed over a range of 500 μm, with passing being indicated for cases in which the maximum height of surface roughness Rmax was 1000 nm or less.

The overall evaluation results were made passing if the damage resistance test and hardness test were passed and also the maximum height of surface roughness Rmax was 1000 nm or smaller.

Note that in the following Tables 1 to 4, the symbols ○, Δ, and denote the meaning of Good, Inferior and Bad, respectively.

For Table 1, a JIS class 2 pure titanium (corresponding to ASTM grade 2) with average crystal grain sizes of approximately 15 μm and approximately 80 μm were used, the table showing the results of the damage resistance test, the surface hardness test, the surface roughness test, and the average crystal grain sizes, for the case of before processing, the cases of after processing performed at various temperatures in the range from 650° C. to 900° C., and for processing by the method of the prior art.

In Table 1, a and i indicate the evaluation results obtained before processing, b and j indicate the evaluation results obtained with processing at 650° C., c and k indicate the evaluation results with processing at 700° C., d and 1 indicate the evaluation results obtained with processing at 750° C., e and m indicate the evaluation results obtained with processing at 800° C., f and n indicate the evaluation results obtained with processing at 850° C., g and o indicate the evaluation results obtained with processing at 900° C., and h and p indicate the results obtained with prior art processing at 850° C. for 10 hours.

From a and g of Table 1, it can be seen that, with respect to a JIS class 2 pure titanium (corresponding to ASTM grade 2), which has a maximum height of surface roughness Rmax of 50 nm or smaller, there is an increase to 1500 nm, this representing a roughening of the surface. From a and d, it can be seen that the surface roughness according to the present invention has a maximum height of 1000 nm or less, which is lower than that of the prior art. In comparison with the roughened crystal grain size of 80 to 200μm with the prior art, the present invention produces a crystal grain size of 10 to 30 μm, which shows that a grain size is maintained that is approximately the same as the grain size of pure titanium before processing.

Because the cases indicated by h through n exhibit an enlarging of the initial crystal grain size, the crystal grain size for even processing at 650° C. exhibits a large maximum height of surface roughness of 1000 nm.

At temperatures of 700° C. and greater, the maximum height of surface roughness increases even further.

As described above, the maximum height of surface roughness is correlated to the protrusions at the crystal grain boundaries, and the fact that the maximum height of surface roughness according to the present invention is small is thought to be attributed to the fact that the crystal grain size in the present invention is small.

For Table 2, a JIS class 4 pure titanium (corresponding to ASTM grade 4) with an average crystal gain size of 10 μm, a titanium alloy having a composition of Ti, 4.5 wt % Al, 3 wt % V, 2 wt % Mo and a titanium alloy having a composition of Ti, 3 wt % Al, 2.5 wt % V were used, the table showing the damage resistance test, the surface hardness test, the surface roughness test, and the crystal grain sizes, for the cases of before hardening, the cases of after processing performed at various temperatures in the range from 650° C. to 900° C., the case of processing according to the present invention with a processing time of 3 hours, and the case of processing by the method of the prior art.

As can be seen from Table 2, when the first hardening step is performed with a holding time of 3 hours at a processing temperature in the range from 700° C. to 850° C., the pure titanium corresponding to JIS class 4, the titanium allow with a composition of Ti, 4.5 wt % Al, 3 wt % V, 2 wt % Mo and the titanium alloy having a composition of Ti, 3 wt % Al, 2.5 wt % V all exhibited no coarsening of the crystal grain size, had a low surface roughness, exhibited an increase in hardness, and exhibited good resistance to damage.

However, there was roughening of the surface at a temperature of 900° C. Also, with prior art gas nitriding there was a coarsening of the crystal grain size and an increase in the surface roughness. The reason why the surface roughness of the surfaces of these titanium materials is small is thought to be attributed to the small crystal grain size before processing.

Therefore, what is important in not causing an increase in the surface roughness is to make the crystal grain size small in the initial stage, that is, to make the crystal grain size small before processing, and to performing processing within a temperature range in which the processed surface crystal grain size is not made coarse, and to control the timing of the introduction of gas by controlling the temperature and the time, such as is done in the present invention.

That is, not causing a coarsening of the crystal grain size that grows in a planer direction on the processed surface is a factor in no allowing an extreme increase in the maximum height of the surface roughness.

Table 3 shows the results obtained by processing using the processing method of the present invention, using a variety of gases, in comparison with the method of the prior art. As can be seen, it is also possible to use nitriding gases or oxidation gases such as $N_2O$, NO, and $NO_2$.

Although the materials used as the decorative titanium material in the foregoing description was pure titanium material corresponding to JIS class 2 and JIS class 4, application is also possible to JIS class 1 and JIS class 3 titanium material.

Additionally, although titanium alloys having compositions of Ti, 4.5 wt % Al, 3 wt % V, 2 wt % Mo and Ti, 3 wt % Al, 2.5 wt % V were used in the foregoing description, it is also possible to use another α-type titanium alloy, another α+β type titanium alloy, and also a β-type alloy, what is important being not to exceed the transformation temperature, and to establish the temperature and time so that there is not a coarsening of the crystal grains.

While the foregoing description was for the case of a mirror-polished surface, there is no particular restriction in this regard, and it is also possible to apply the present invention to the cases of a surface that is relatively rough, such as a polished surface, a honed surface which has been suffered from a honing treatment, a shot-peened surface, and a hairline surface.

In the above-described example of the present invention, in the first, third, and fourth embodiments the description is that of the case of a sheet-shaped hardened titanium material, and in the second embodiment the description is that of the case of a wrist watch case.

However, there is no restriction to these materials, and the meaning of the examples is that application is possible to such decorative items as a titanium wrist watch band, bezel, pierced or other earrings, rings, and eyeglass frames and the like.

Application is also possible to such products as the head and shaft of a golf club, the frame of a bicycle, and any other product that is an application of a titanium material.

In the embodiments of the present invention, although the description was for the case in which the atmosphere in the temperature raising step, the second atmosphere adjustment step, and the cooling step was an inert gas of argon or helium, if a nitrogen and a gas that includes nitrogen is introduced between the above-noted steps, a compound is formed on the surface, this causing a roughening and discoloration of the surface, the atmosphere can be a gas that is not affect by these gases, and can be a high vacuum atmosphere as well.

In the embodiments of the present invention, although the description was for the case in which the time in each case for the first processing step was 3 hours, and the processing temperature was 700° C., there is no particular need for restriction to these conditions, what is important being that processing is performed at a temperature and within a time range in which there is not a coarsening of the crystal grains that grow in a planar direction on the processed surface, and that the time and the temperature conditions be set so as to satisfy the required hardness and resistance to damage.

Therefore, because processing over a long period of time or and the elevation of the processing temperature influence the coarsening of the crystal grains, the time can be set arbitrarily within 10 hours. With regard to processing temperature, although it is preferable to perform processing at as low a temperature as possible, so that surface roughness is not a problem, the temperature can be an arbitrary temperature above 700° C., so long as the temperature is below the $\alpha$ to $\beta$ transformation point.

In the embodiments of the present invention, although the description is for the case in which, in the first processing step, the water vapor concentration and oxygen concentration is described as being approximately 4000 ppm for water vapor concentration and approximately 5000 ppm for oxygen concentration, there is no particular reason for such as restriction, the required water vapor be arbitrarily establishable within the range of 300 to 30000 ppm, and the oxygen concentration being arbitrarily establishable in the range 300 to 20000 ppm.

What is important is that if these gases are supplied in an excessive amount, the surface will become discolored by an oxide, and if the amount of gas is insufficient, there will be an insufficient amount of oxidation. Thus, the concentration can be adjusted arbitrarily, as long as it is within these extremes.

In the embodiments of the present invention, while the description is for the case of a processing pressure in all steps of 0.1 torr, there is no particular reason for a restriction in this regard, and any arbitrary pressure in the range from 0.001 to 10 torr can be used.

What is important is, similar to the processing concentration, that if the pressure is too low the absolute amount of diffused element will be insufficient, and if the pressure is too high a compound will form on the surface, so that the setting should be made between this range.

In the embodiments of the present invention, while the description is for the case of a processing time of 0.5 hour for the second atmosphere adjustment step, there is no particular reason for a restriction in this regard, and it is possible to set the time arbitrarily as long as the atmosphere is inert before entering the cooling step.

Next, another example of a method of processing a decorative titanium material will be described as the fifth embodiment of the present invention, with reference being made to the drawings.

Embodiment 5

Specifically, this additional example of a processing method according to the present invention, as noted above, is a method of processing a decorative titanium material that has a hardened layer on the surface thereof, this method having a step of forming a protective film onto the surface of the decorative titanium material with a crystal grain size in the range from 0.1 to 60 $\mu$m, a step of heating the titanium material with a rising temperature in an inert gas atmosphere, a first processing step of heating the material to a temperature of at least 700° C. in an atmosphere that includes oxygen and nitrogen, a second atmosphere adjustment step of heating the titanium material in an inert gas atmosphere of argon or helium or the like to a processing temperature of at least 700° C., and a step of cooling the titanium material in an inert gas atmosphere.

Figure 8:
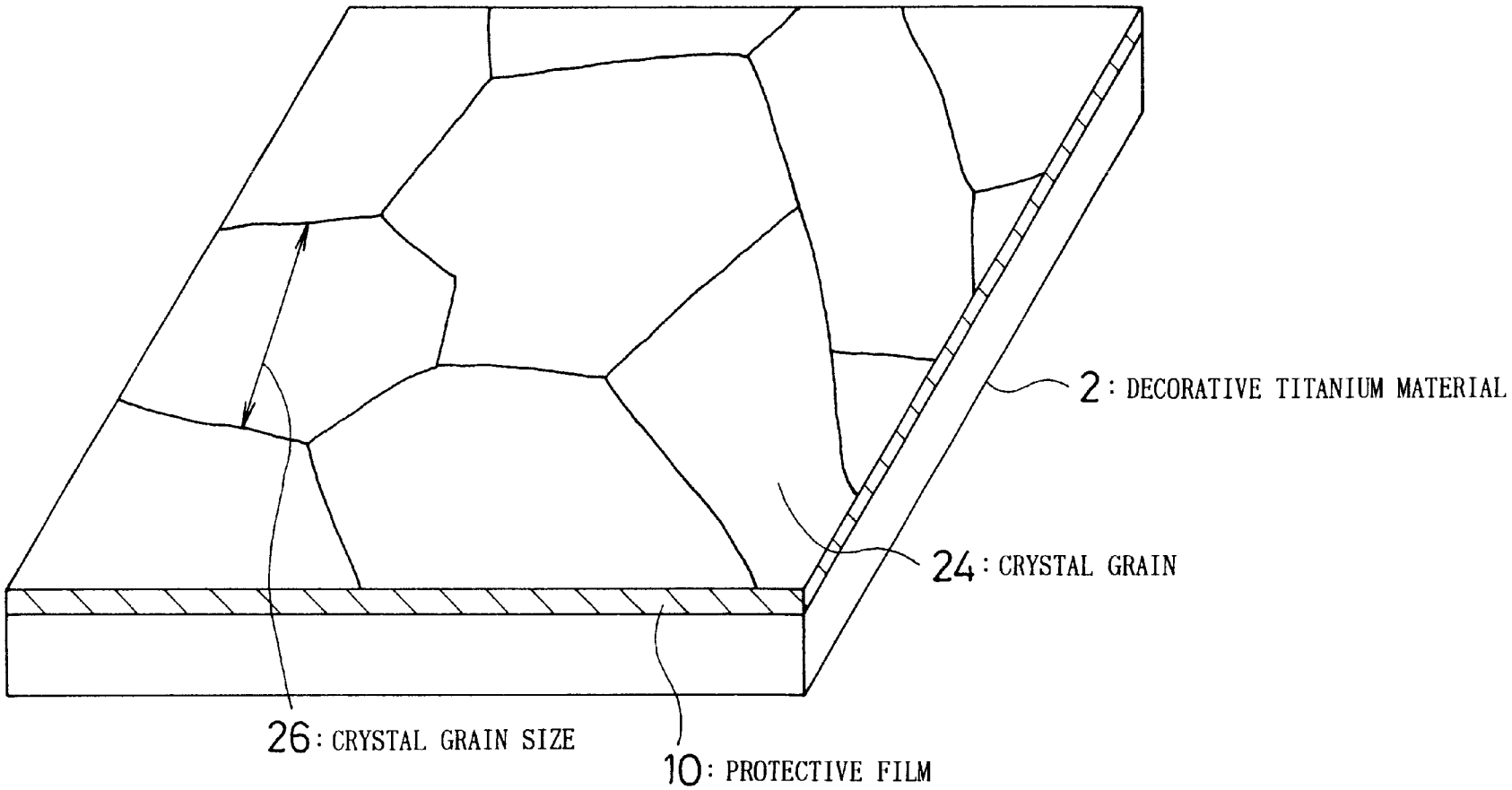
FIG. 8 is a drawing that shows an example of the condition of a decorative titanium material having a protective layer, to which the hardening method according to the present invention can be applied.

This method of processing a decorative titanium material according to the present invention will be described below, with reference being made to the drawings. FIG. 8 is a perspective view that shows an unprocessed decorative titanium material, a perspective view of a titanium material after processing having already been presented as described above in FIG. 1.

Figure 7:
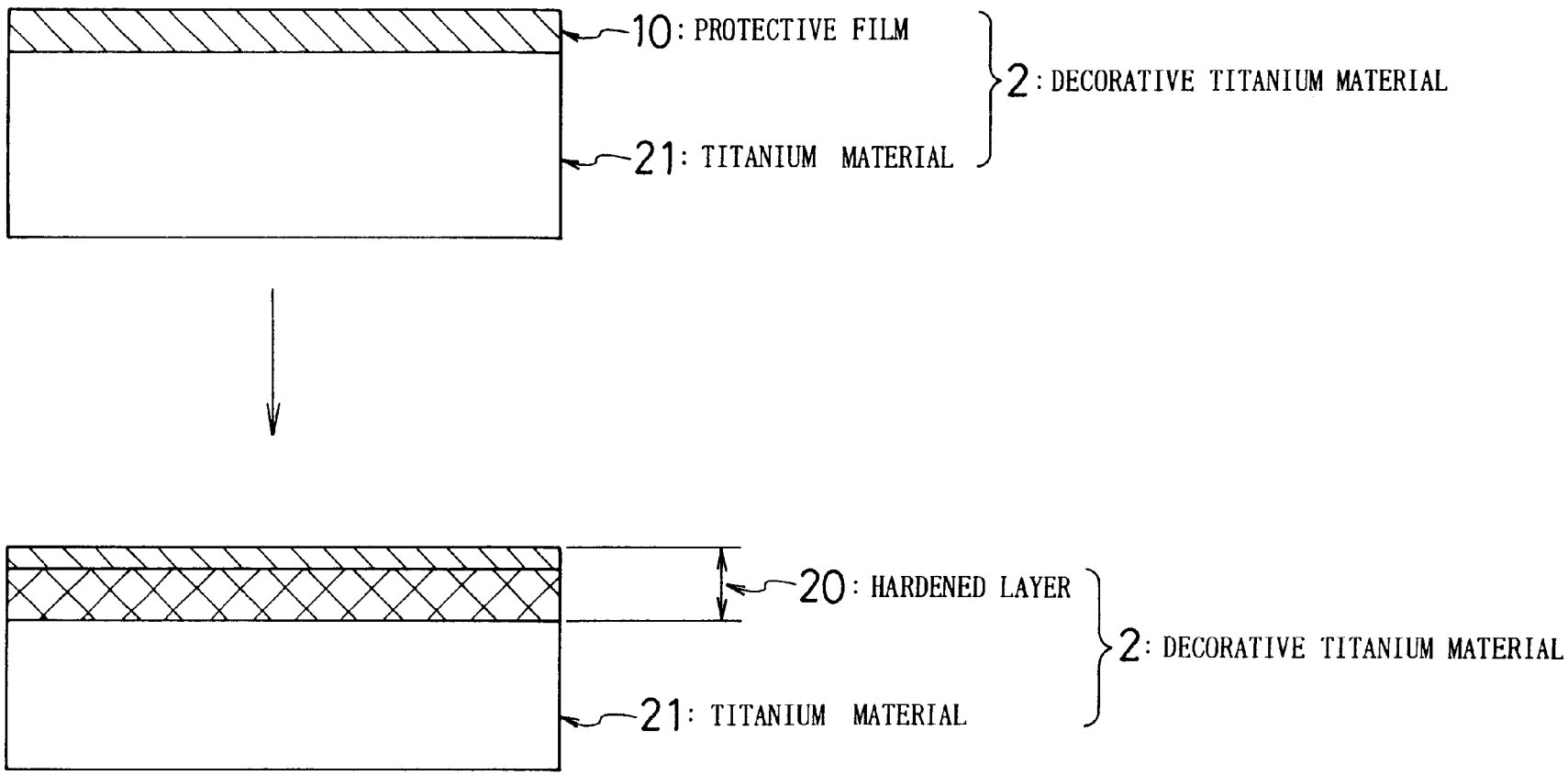
FIG. 7 is a drawing that shows the example of forming a protective film onto a decorative titanium material according to the present invention and then performing processing.

A feature of this example of the present invention is that, after first forming a protective film having a microfine structure on the surface of the titanium material, a hardened layer is formed, the method of processing being generally indicated in FIG. 7.

In this embodiment, a JIS class 2 pure titanium measuring 25 mm by 25 mm is used as the decorative titanium material. The surface to be processed is polished, and the surface roughness is such that the maximum height of surface roughness Rmax value is 50 nm or less. As shown in FIG. 8, the crystal structure is uniform and the size of the crystal grains before processing is within the range from 50 to 100 $\mu$m.

The formation of the protective film is done by a method selected, depending upon the type of protective film, from a group of methods consisting of the vapor deposition method, the sputtering method, the plasma CVD method, and the DC sputtering method. For a Ti protective film formed by the RF sputtering method, high-purity titanium is used as the sputtering target, and the introduced gas is argon was having a high purity.

A pure titanium sample is disposed within the RF sputtering apparatus in opposition to the RF target. A vacuum pumping unit is used to exhaust to a vacuum level in the range from $1\times10^{-1}$ to $1\times10^{-6}$ torr or lower, after which a prescribed amount of the high-purity argon gas is introduce by means of a flow meter, so that the pressure within the vacuum chamber is in the range 0.001 to 0.1 torr.

Then, RF power at 13.56 MHz is applied to the pure titanium target, and a Ti film having a microfine structure is formed at a precalculated rate to a film thickness of 1.0 $\mu$m. When this is done, to form a titanium film having a fine structure in the range of 0.1 to 60 $\mu$m, it is important to control the temperature of the surface of the pure titanium.

In this embodiment, the method applied is that of actively using water cooling so that the surface temperature of the pure titanium is in the range from 0 to 50° C. when the film is formed.

If the surface temperature exceeds 50° C., the crystal grains of the pure titanium itself, that is, of the base metal itself, will be affected. That is, a crystal grain having a fine structure of 1 to 60 $\mu$m is not obtained, the crystal grain size being greater than 60 $\mu$m.

First, in the processing of the processing method shown in FIG. 3, at the vacuum exhausting step 28, the inside of the vacuum chamber 6 is exhausted by the vacuum pumping units 16, to a vacuum level of $1\times10^{-5}$ torr or below.

A prescribed amount of an inert gas such as argon or helium is introduced from the gas conduit 8, this amount of introduced gas and the exhaust amount being adjusted so as to achieve an inert gas atmosphere within the vacuum chamber 6 having a vacuum pressure of 0.1 torr.

Then, as indicated by the temperature raising step 30, the decorative titanium material 2 is heated by the heating means 12, so that its temperature rises to the processing temperature of 700° C.

At the first processing step 32, a gas mixture that includes pure nitrogen and oxygen is introduced from the gas conduit 8, this amount of introduced gas and the exhaust amount being adjusted so as to achieve an atmosphere of nitrogen and oxygen having a vacuum pressure of approximately 0.1 torr.

The proportion of oxygen with respect to the nitrogen is made to be approximately 5000 ppm.

Then, while maintaining a constant processing temperature, the above condition is held for approximately 3 hours, after which the atmosphere within the vacuum chamber 6 is again established as a reduced-pressure inert gas atmosphere, this being maintained for approximately 0.5 hour, and the second atmosphere adjustment step is performed.

Cooling is performed with the inert gas atmosphere remaining and, when the decorative titanium material reaches a temperature at which its surface will not be oxidized, processing is completed and the specimen is taken out.

That is, in this embodiment, as described above, a protective film having a crystal grain size of 0.1 to 60 $\mu$m is formed by the sputtering method onto the surface of a JIS class 2 pure titanium specimen, and heat treating in a nitrogen atmosphere is performed in a vacuum heat treating oven so as to form a hardened layer.

Table 4 is a table which shows a comparison of the evaluation results obtained with the present invention and with the prior art, the evaluation method used being that of using surface hardness, Vickers hardness, and crystal grain size. The maximum height of surface roughness was obtained by using a surface roughness meter, the Vickers hardness was obtained by using a microhardness meter, and the crystal grain size was obtained by observing the surface using an electron microscope.

The results of evaluating a specimen onto which a protective film was formed were taken as passing if the maximum height of surface roughness was 300 nm or less, and also the surface hardness was 1200 or greater.

In Table 4, A shows the evaluation results for an unprocessed JIS class 2 pure titanium specimen, B show the evaluation results for processing using the method of the prior art, and C shows the evaluation results with processing by the method of the present invention, in which a hardened layer is formed after forming a protective layer.

From A and B of Table 4, it can be seen that the surface roughness with the prior art processing results in a maximum height of the surface roughness that is increased to 600 nm with respect to a maximum height of the surface roughness 100 nm for an unprocessed pure titanium specimen. In contrast to this, from A and C of Table 4, it can be seen that the surface roughness with the processing of the present invention is 200 nm, which is less than the prior art.

Additionally, in contrast to the crystal grain size with the prior art of 80 to 200 nm, the crystal grain size with the processing of the present invention is smaller, this being 20 to 50 $\mu$m.

The maximum height of surface roughness corresponds to the protrusions at the crystal grain boundary, as discussed above, and the fact that the maximum height of surface roughness with the present invention is low is thought to be attributable to the fact that the crystal grain size in the present invention is small.

Although JIS class 2 pure titanium was used in the description of this embodiment, application is also possible to JIS class 1 pure titanium material or to JIS class 3 titanium material, and to a titanium alloy that has titanium as a base metal.

There is also no particular restriction with regard to the surface processed, it being possible to apply the present invention to the cases of a surface that is relatively rough, such as a honed surface, a shot-peened surface, and a hairline surface.

Although the description of the embodiment was for the case of using a Ti film as the protective film, the method of formation of the protective film can be done, depending upon the type of film, by a method selected from the methods of vapor deposition, sputtering, plasma CVD, and DC sputtering, and can be applied to a protective film of $TiO_2$ or TiN as well.

Additionally, although the description of the embodiment was done for the example of using nitrogen gas for formation of the hardened layer, it is also possible to apply this method when using an oxidation or nitriding gas such as $NO_2$, NO, $N_2$, or $N_2O$ or the like.

Next, yet another example of a method of processing according to the present invention will be described as the sixth embodiment of the present invention.

Embodiment 6

This embodiment is a method of processing a titanium material, which has a step of forming a protective film onto the surface of the decorative titanium material with a crystal grain size in the range from 0.1 to 60 $\mu$m, a step of heating the titanium material with a rising temperature in an inert gas atmosphere, a first processing step of heating the material to a temperature of at least 700° C. in an atmosphere that includes nitrogen and water vapor, a second atmosphere adjustment step of heating the titanium material in an inert gas atmosphere of argon or helium or the like to a processing temperature of at least 700° C., and a step of cooling the titanium material in an inert gas atmosphere.

In this embodiment, JIS class 2 pure titanium measuring 25 mm by 25 mm is used as the decorative titanium material. The surface to be processed is polished, and the surface roughness is such that the maximum height of surface roughness Rmax value is 50 nm or less.

As shown in FIG. 8, the crystal structure is uniform and the size of the crystal grains before processing is within the range from 60 to 100 $\mu$m.

An RF sputtering apparatus was used to form a Ti film as the protective film. A pure titanium sputtering target was used as the RF target, and argon gas of extremely high purity was used as the introduced gas.

The specimen was disposed within the RF sputtering apparatus in opposition to the RF target.

A vacuum pumping units is used to exhaust to a vacuum level in of $1\times10^{31\ 5}$ torr or lower, after which a prescribed amount of the high-purity argon gas is introduce by means of a flow meter, so that the pressure within the vacuum chamber established as approximately 0.001 torr.

Then, RF power at 13.56 MHz is applied to the pure titanium target, and a Ti film having a microfine structure is formed at a precalculated rate to a film thickness of 3.0 $\mu$m.

When this is done, to form a titanium film having a fine structure in the range of 1 to 50 $\mu$m, it is important to control the temperature of the surface of the pure titanium.

In this embodiment, the method applied is that of actively using water cooling so that the surface temperature of the pure titanium is in the range from 0 to 50° C. when the film is formed.

If the surface temperature exceeds 50° C., the crystal grains of the pure titanium itself, that is, of the base metal itself, will be affected. That is, a crystal grain having a fine structure of 1 to 60 $\mu$m is not obtained, the crystal grain size being greater than 60 $\mu$m.

First, following the conceptual presentation of the processing of the processing method shown in FIG. 3, at the vacuum exhausting step 28, the inside of the vacuum processing chamber 6 is exhausted by the vacuum exhausting apparatus 16, to a vacuum level of $1\times10^{-5}$ torr or below.

A prescribed amount of an inert gas such as argon or helium is introduced from the gas conduit 8, this amount of introduced gas and the exhaust amount being adjusted so as to achieve an inert gas atmosphere within the vacuum processing chamber 6 having a vacuum pressure of 0.1 torr.

Then, as indicated by the temperature raising step 30, the titanium material 2 is heated by the heating means 12, so that its temperature rises to the processing processing temperature of 700° C.

At the first processing step 32, a gas mixture that includes pure nitrogen with a minute amount of water vapor is introduced from the gas conduit 8, this amount of introduced gas and the exhaust amount being adjusted so as to achieve an atmosphere of nitrogen and the minute amount of water vapor having a vacuum pressure of 0.1 torr.

The proportion of water vapor with respect to the nitrogen is made to be approximately 4000 ppm. Then, while maintaining a constant processing temperature, the above condition is held for approximately 3 hours, after which the atmosphere within the vacuum chamber 6 is again established as a reduced-pressure inert gas atmosphere, this being maintained for approximately 0.5 hour, and the second atmosphere adjustment step is performed.

Cooling is then performed with the inert gas atmosphere remaining and, when the decorative titanium material reaches a temperature at which its surface will not be oxidized, processing is completed and the specimen is taken-out.

As described above in detail, the material produced according to the present invention is a hardened decorative titanium material having a hardened layer on the surface thereof, the hardened surface layer including the nitrogen or oxygen, and the surface crystal grain size being in the range from 1 to 60 $\mu$m, and a decorative titanium material having a surface with a maximum height value of surface roughness Rmax that is 1000 nm or less.

The method of processing according to the present invention has a step of heating the titanium material to with a rising temperature in an inert gas atmosphere, a first processing step of heating the material to a processing temperature of at least 700° C. in an atmosphere that includes nitrogen and oxygen, a second atmosphere adjustment step of heating the titanium material in an inert gas atmosphere of argon or helium or the like to a processing temperature of at least 700° C., and a step of cooling the titanium material in an inert gas atmosphere, this processing resulting in a hardened titanium material that has a small surface roughness and which has an surface appearance that is not deteriorated.

More specifically, with regard to a decorative titanium material having a hardened layer on the surface thereof, by means of step of forming a protective film having a fine crystal grain of 0.1 to 60 $\mu$m onto the surface of the decorative titanium material, and a processing step whereby a hardened layer is formed by heating the decorative titanium material in an atmosphere that includes nitrogen and oxygen at a reduced pressure, it is possible to achieve a small surface roughness which is maintained as the processing is performed.

By doing this, even after processing the titanium itself, there is no deterioration in the appearance thereof, this material being particularly applicable for use as a decorative material.

TABLE 1

| Numbre | Material | Processing Temperature (° C.) | Gas Used | Damage Resistance Test | Hardness | Crystal Grain Size | Surface Roughness | Overall Evaluation |
|---|---|---|---|---|---|---|---|---|
| a | Pure Ti class 2 | Unprocessed | | X | X | Small | ○ | X |
| b | Pure Ti class 2 | 650 | $N_2 + H_2O$ | X | X | Small | ○ | X |
| c | Pure Ti class 2 | 700 | $N_2 + H_2O$ | ○ | ○ | Small | ○ | ○ |
| d | Pure Ti class 2 | 750 | $N_2 + H_2O$ | ○ | ○ | Small | ○ | ○ |
| e | Pure Ti class 2 | 800 | $N_2 + H_2O$ | ○ | ○ | Small | ○ | ○ |
| f | Pure Ti class 2 | 850 | $N_2 + H_2O$ | ○ | ○ | Large | X | X |

TABLE 1-continued

| Numbre | Material | Processing Temperature (° C.) | Gas Used | Damage Resistance Test | Hardness | Crystal Grain Size | Surface Roughness | Overall Evaluation |
|---|---|---|---|---|---|---|---|---|
| g | Pure Ti class 2 | 900 | $N_2 + H_2O$ | ○ | ○ | Large | X | X |
| h | Pure Ti class 2 | Prior art | $N_2$ | ○ | ○ | Large | X | X |
| i | Pure Ti class 2 | Unprocessed | | X | X | Large | ○ | X |
| j | Pure Ti class 2 | 650 | $N_2 + H_2O$ | X | X | Large | Δ | X |
| k | Pure Ti class 2 | 700 | $N_2 + H_2O$ | ○ | ○ | Large | X | X |
| l | Pure Ti class 2 | 750 | $N_2 + H_2O$ | ○ | ○ | Large | X | X |
| m | Pure Ti class 2 | 800 | $N_2 + H_2O$ | ○ | ○ | Large | X | X |
| n | Pure Ti class 2 | 850 | $N_2 + H_2O$ | ○ | ○ | Large | X | X |
| o | Pure Ti class 2 | 900 | $N_2 + H_2O$ | ○ | ○ | Large | X | X |
| p | Pure Ti class 2 | Prior art | $N_2$ | ○ | ○ | Large | X | X |

TABLE 2

| Numbre | Material | Processing Temperature (° C.) | Type of Gas Used in First Hardening Step | Damage Resistance Test | Hardness | Crystal Grain Size | Surface Roughness | Overall Evaluation |
|---|---|---|---|---|---|---|---|---|
| q | Pure Ti corresponding to class 4 | Unprocessed | | X | X | Small | ○ | X |
| r | Pure Ti corresponding to class 4 | 650 | $N_2 + H_2O$ | X | X | Small | ○ | X |
| s | Pure Ti corresponding to class 4 | 700 | $N_2 + H_2O$ | ○ | ○ | Small | ○ | ○ |
| t | Pure Ti corresponding to class 4 | 850 | $N_2 + H_2O$ | ○ | ○ | Large | X | X |
| u | Pure Ti corresponding to class 4 | 900 | $N_2 + H_2O$ | ○ | ○ | Large | X | X |
| v | Pure Ti corresponding to class 4 | Prior art | $N_2$ | ○ | ○ | Large | X | X |
| w | Ti—4.5Al—3V—2Mo | Unprocessed | | Δ | X | Small | ○ | Δ |
| x | Ti—4.5Al—3V—2Mo | 650 | $N_2 + H_2O$ | Δ | X | Small | ○ | Δ |
| y | Ti—4.5Al—3V—2Mo | 700 | $N_2 + H_2O$ | ○ | ○ | Small | ○ | ○ |
| z | Ti—4.5Al—3V—2Mo | 850 | $N_2 + H_2O$ | ○ | ○ | Large | X | X |
| aa | Ti—4.5Al—3V—2Mo | 900 | $N_2 + H_2O$ | ○ | ○ | Large | X | X |
| ab | Ti—4.5Al—3V—2Mo | Prior art | $N_2$ | ○ | ○ | Large | X | X |
| ac | Ti—3Al—2.5V | Unprocessed | | X | X | Small | ○ | X |
| ad | Ti—3Al—2.5V | 650 | $N_2 + H_2O$ | X | X | Small | ○ | X |
| ae | Ti—3Al—2.5V | 700 | $N_2 + H_2O$ | ○ | ○ | Small | ○ | ○ |
| af | Ti—3Al—2.5V | 850 | $N_2 + H_2O$ | ○ | ○ | Large | X | X |
| ag | Ti—3Al—2.5V | 900 | $N_2 + H_2O$ | X | X | Large | X | X |
| ah | Ti—3Al—2.5V | Prior art | $N_2$ | X | X | Large | X | X |

TABLE 3

| Numbre | Material | Processing Temperature (° C.) | Type of Gas Used in First Hardening Step | Damage Resistance Test | Hardness | Crystal Grain Size | Surface Roughness | Overall Evaluation |
|---|---|---|---|---|---|---|---|---|
| al | Pure Ti class 2 | 700 | $N_2 + O_2$ | ○ | X | Small | ○ | Δ |
| am | Pure Ti class 2 | 800 | $N_2 + O_2$ | ○ | ○ | Small | ○ | ○ |
| an | Pure Ti class 2 | Prior art | $N_2 + O_2$ | ○ | ○ | Large | X | X |
| ar | Pure Ti class 2 | 700 | $Ar + N_2O$ | ○ | ○ | Small | ○ | ○ |
| as | Pure Ti class 2 | 700 | Ar + NO | ○ | ○ | Small | ○ | ○ |
| at | Pure Ti class 2 | 700 | $Ar + NO_2$ | ○ | ○ | Small | ○ | ○ |

TABLE 4

| | Vickers Hardness | Maximum Height Rmax (nm) | Cyrstal Grain Size (μm) | Evaluation Results |
|---|---|---|---|---|
| A Before processing | 180 | 100 | 50 ~ 100 | — |
| B Results of prior art processing | 1350 | 600 | 80 ~ 200 | X |
| D Results of present invention processing (after formation of hardened layer) | 1500 | 200 | 20 ~ 50 | ○ |

What is claimed is:

1. A method of processing a titanium material comprising the steps of:

(a) heating a titanium material in a reduced pressure, inert gas atmosphere wherein the temperature of said titanium rises to at least 700° C.;

(b) exposing said heated titanium material, maintained at a temperature of at least 700° C., to a first atmosphere, said first atmosphere being nitrogen and oxygen or nitrogen and water vapor, wherein said nitrogen is present in predominant concentration;

(c) exposing said heated titanium material, maintained at a temperature of at least 700° C., to a reduced pressure, inert atmosphere; and (d) cooling said titanium material in said reduced pressure inert atmosphere until a non-oxidizing temperature is reached.

2. A method in accordance with claim 1 wherein said second inert atmosphere is argon or helium.

3. A method in accordance with claim 1 wherein said step (a) comprises first reducing the pressure to a vacuum level of $1\times10^{-5}$ torr or less and then introducing an inert gas wherein the pressure is raised to about 0.1 torr; and said step (b) occurs at a pressure in the range of 0.1 to 10 torr.

4. A method of processing a decorative material comprising the steps of:

(a) forming a protective film having crystal grains in a size range of between 0.1 and 60 microns over a surface of a decorative titanium material;

(b) heating said decorative titanium material in a reduced pressure, inert gas atmosphere wherein the temperature of said decorative titanium material rises to at least 700° C;

(c) exposing said decorative titanium material, maintained at a temperature of at least 700° C, to a first atmosphere, said first atmosphere being nitrogen and oxygen or nitrogen and water vapor, wherein said nitrogen is present in predominant concentration;

(d) exposing said heated decorative material, at a temperature of at least 700° C, to a reduced pressure, inert atmosphere; and (e) cooling said decorative titanium material in a reduced pressure, inert atmosphere until a non-oxidizing temperature is reached.

5. A method in accordance with claim 4 wherein said second inert atmosphere is argon or helium.

6. A method in accordance with claim 4 wherein said step (b) comprises first reducing the pressure to a vacuum level of $1\times10^{-5}$ torr or less and then introducing an inert gas wherein the pressure is raised to about 0.1 torr; and said step (c) occurs at a pressure in the range of 0.1 to 10 torr.

7. A decorative hardened titanium material that has a hardened layer on a surface thereof, said hardened surface layer including the elements of nitrogen and oxygen, each of which is kept in a solid-dissolving condition therein, and crystal grains having a size in the range of from 0.1 to 60 microns, said decorative titanium hardened material produced by a method comprising the steps of:

(a) heating a decorative titanium material in a reduced pressure, inert gas atmosphere wherein the temperature of said decorative titanium material rises to at least 700° C;

(b) exposing said heated decorative titanium material, maintained at a temperature of at least 700° C, to a first atmosphere, said first atmosphere being nitrogen and oxygen or nitrogen and water vapor, wherein said nitrogen is present in predominant concentration;

(c) exposing said heated decorative titanium material, maintained at a temperature of at least 700° C, to a reduced pressure, inert gas atmosphere; and (d) cooling said titanium material in a reduced pressure, inert atmosphere until a non-oxidizing temperature is reached.

8. A material in accordance with claim 7 wherein said step (a) comprises first reducing the pressure to a vacuum level of $1\times10^{-5}$ torr or less and then introducing an inert gas wherein the pressure is raised to about 0.1 torr; and said step (b) occurs at a pressure in the range of 0.1 to 10 torr.

9. The decorative hardened titanium material comprising a decorative titanium material that has a hardened layer on a surface thereof, said hardened surface layer including the elements of nitrogen and oxygen, each of which is kept at a solid-dissolving condition therein, and crystal grains having a size in the range of from 0.1 to 60 microns, said decorative hardened material produced by a method comprising the steps of:

(a) forming a protective film having crystal grains in a size range of between 0.1 and 60 microns on a surface of a decorative titanium material;

(b) heating said temperature titanium material in a reduced pressure, inert gas atmosphere wherein the temperature of said decorative titanium material rises to at least 700° C;

(c) exposing said heated decorative titanium material, maintained at a temperature of at least 700° C, to a first atmosphere, said first atmosphere being nitrogen and oxygen or nitrogen and water vapor, wherein said nitrogen is present in predominant concentration;

(d) exposing said heated decorative titanium material, maintained at a temperature of at least 700° C, to a reduced pressure, inert atmosphere; and (e) cooling said decorative titanium material in a reduced pressure, inert gas atmosphere until a non-oxidizing temperature is reached.

10. A material in accordance with claim 9 wherein said step (b) comprises first reducing the pressure to a vacuum level of $1\times10^{-5}$ torr or less and then introducing an inert gas wherein the pressure is raised to about 0.1 torr; and said step (c) occurs at a pressure in the range of 0.1 to 10 torr.

* * * * *